United States Patent [19]

Takeuchi et al.

[11] 4,231,817

[45] Nov. 4, 1980

[54] EXTRUDED CORROSION RESISTANT STRUCTURAL ALUMINUM ALLOY

[75] Inventors: Yo Takeuchi, Urawa; Koichi Ohbori, Ohmiya; Masabumi Hatsushika, Kitamoto; Shinichi Komori, Urawa, all of Japan

[73] Assignee: Mitsubishi Kinzoku Kabushiki Kaisha, Ohtemachi, Japan

[21] Appl. No.: 959,094

[22] Filed: Nov. 9, 1978

[51] Int. Cl.[3] ..... C22C 21/10

[52] U.S. Cl. ..... 148/32.5; 75/141; 75/146; 148/12.7 A; 148/159

[58] Field of Search ..... 75/141, 146; 148/32, 148/32.5, 12.7 A, 159

[56] References Cited

U.S. PATENT DOCUMENTS

| | | | |
|---|---|---|---|
| 3,332,773 | 7/1967 | Dudas et al. | 75/146 |
| 3,676,113 | 7/1972 | Pryor et al. | 75/141 |

OTHER PUBLICATIONS

Registration Record of Aluminum Association Alloy Designations and Chemical Composition Limits for Wrought Aluminum Alloys, revised as of Jun. 1, 1974, pp. 5–7.

Sudholter, Metall, 25 Jahrgang, Heft 3, Mar., 1971, pp. 251–256.

*Primary Examiner*—R. Dean

*Attorney, Agent, or Firm*—Frishauf, Holtz, Goodman & Woodward

[57] ABSTRACT

A corrosion resistant structural aluminum alloy excellent in extrudability which consists essentially of, in weight percentage:

Magnesium from 0.45 to 0.98%,
Silicon from 0.3 to 0.8%,
Zinc from 0.5 to 2.5%, and, the balance aluminum and incidental impurities; said alloy including a corrosion resistant structural aluminum alloy cxcellent in extrudability further additionally containing, as required, at least one element selected from the group consisting of, in weight percentage:

Copper from 0.04 to 0.30%,
Zirconium from 0.04 to 0.25%,
Chromium from 0.04 to 0.30%, and
Manganese from 0.04 to 0.25%.

4 Claims, No Drawings

EXTRUDED CORROSION RESISTANT STRUCTURAL ALUMINUM ALLOY

REFERENCE TO PATENTS, APPLICATIONS AND PUBLICATIONS PERTINENT TO THE INVENTION

So far as we know, the prior documents pertinent to the present invention are as follows:

(1) Registration Record of Aluminum Association Alloy Designation and Chemical Composition Limits for Wrought Aluminum Alloys, published by the Aluminum Association of America (revised as of June 1, 1974), on pages 5 through 7;

(2) The Metall, published by Metal-Verlag GmbH (25 Jahrgang, Heft 3, March 1971), on page 251; and (3) The U.S. patent application Ser. No. 876,275 filed on Feb. 9, 1978, U.S. Pat. No. 4,169,728.

FIELD OF THE INVENTION

The present invention relates to a corrosion resistant aluminum alloy excellent in extrudability, which is adapted to serve as a material for structural sections, has a strength of from 25 to 40 kg/mm$^2$, particularly from 30 to 40 kg/mm$^2$ after a heat treatment, and contains magnesium, silicon and zinc as indispensable constituents.

BACKGROUND OF THE INVENTION

Recently aluminum alloys have increasingly been used widely as materials for structural sections for buildings and transport vehicles because they are light in weight and beautiful in appearance, have a strength and a corrosion resistance sufficient to permit application as materials for structural sections, and furthermore, are excellent in workability. A structural section of aluminum alloy is usually manufactured by extrusion so as to make the fullest possible use of properties thereof. When using an aluminum alloy as a material, manufacture into extruded sections permits expectation of reduced time and labor, an improved material yield and a higher dimensional accuracy than manufacture into rolled sections.

Conventionally, aluminum-magnesium-silicon alloys (hereinafter referred to as "Al-Mg-Si alloys") have long been used as corrosion resistant heat-treatable wrought aluminum alloys. Especially, an Al-Mg-Si alloy containing from 0.45 to 0.9 wt.% Mg and from 0.2 to 0.6 wt.% Si, i.e., JIS (the abbreviation of the "Japanese Industrial Standards") 6063 aluminum alloy is excellent not only in corrosion resistance but also in extrudability in particular. It is therefore a usual practice at present to manufacture most of extruded sections of aluminum alloy from said JIS 6063 alloy. However, said JIS 6063 alloy is defective in that it has a relatively low strength and is not provided with a strength required when using as a material for structural sections, i.e., a strength after a heat treatment of from 25 to 40 kg/mm$^2$, particularly from 30 to 40 kg/mm$^2$ (the strength of from 25 to 40 kg/mm$^2$ is hereinafter referred to as the "medium strength").

From among Al-Mg-Si alloys, JIS 6061 aluminum alloy containing from 0.8 to 1.2 wt.% Mg and from 0.4 to 0.8 wt.% Si, and AA (the abbreviation of the "Standards of the Aluminum Association of America") 6070 aluminum alloy containing from 0.5 to 1.2 wt.% Mg and from 1.0 to 1.7 wt.% Si are known and applied in addition to said JIS 6063 alloy. These two alloys, which have a far higher strength after a heat treatment than said JIS 6063 alloy and a satisfactory corrosion resistance, although slightly inferior to that of said JIS 6063 alloy, are suitable for use as materials for structural sections requiring the medium strength, whereas they are defective in the workability, especially in extrudability. Therefore, said two alloys are problematic because of the too low productivity in extrusion as well as of the production of defects caused by cracks in working.

In the Registration Record of Aluminum association Alloy Designations and Chemical Composition Limits for Wrought Aluminum Alloys (revised as of June 1, 1974) published by the Aluminum Association of America, on pages 5 through 7, of which a copy is attached hereto, there are disclosed AA 6011 aluminum alloy containing from 0.6 to 1.2 wt.% Mg, from 0.6 to 1.2 wt.% Si, up to 1.5 wt.% Zn, from 0.4 to 0.9 wt.% Cu, up to 0.3 wt.% Cr and up to 0.8 wt.% Mn; AA 6253 aluminum alloy containing from 1.0 to 1.5 wt.% Mg, from 0.45 to 0.98 wt.% Si, from 1.6 to 2.4 wt.% Zn, up to 0.1 wt.% Cu and from 0.15 to 0.35 wt.% Cr; and AA 7472 aluminum alloy containing from 0.9 to 1.5 wt.% Mg, up to 0.25 wt.% Si, from 1.3 to 1.9 wt.% Zn, up to 0.05 wt.% Cu and up to 0.05 wt.% Mn. These three alloys are similar to the alloy of the present invention described later in that they contain magnesium, silicon and zinc. However, all said three alloys have chemical compositions different from that of the aluminum alloy of the present invention. Furthermore, said AA 6011 alloy and said 6253 alloy are aluminum alloys exclusively used for special applications such as cladding materials for cladded sheets.

In the paper of Mr. R. Sudhölter presented in the Metall (25 Jahrgang, Heft 3, March 1971) published by Metall-Verlag GmbH, on page 251, there are disclosed an aluminum alloy containing 1.1 wt.% Mg, 0.6 wt.% Si and 2 wt.% Zn and another aluminum alloy further additionally containing 0.15 wt.% Mn. These two alloys are also similar to the aluminum alloy of the present invention in that they contain magnesium, silicon and zinc. However, both said two alloys are aluminum alloys used for casting and are not provided with properties necessary for use in extrusion.

In addition, in the U.S. patent application Ser. No. 876,275 filed on Feb. 9, 1978, U.S. Pat. No. 4,169,728, there is described a corrosion resistant bright aluminum alloy for die casting, consisting of, in weight percentage:

Mg from 1.1 to 3.0%,
Si from 0.2 to 1.2%,
Zn from 0.5 to 2.5%,
Fe from 0.2 to 1.5%,
Mn from 0.3 to 1.2%,
Cu from 0.1 to 0.3%, and, the balance aluminum and incidental impurities; said alloy including a corrosion resistant bright aluminum alloy for die casting further additionally containing from 0.001 to 2.000% in weight precentage in total of at least one element selected from the group consisting of:

Ti from 0.05 to 0.30%,
Cr from 0.05 to 0.50%,
B from 0.01 to 0.05%,
Zr from 0.05 to 0.30%,
V from 0.05 to 0.30%,
Co from 0.05 to 0.50%,
Sb from 0.05 to 0.30%, Ni from 0.05 to 2.00%, and,
Be from 0.001 to 0.005%.

The above-mentioned alloy is also similar to the aluminum alloy of the present invention described later in that the former contains magnesium, silicon and zinc. However, said alloy is an aluminum alloy used for die casting and contains at least 1.1 wt.% Mg to prevent occurrence of casting cracks and iron in a relatively high percentage with a view to improving the strippability of the cast alloy, this resulting in a lower workability, especially a lower extrudability.

There is therefore an increasing demand for a corrosion resistant aluminum alloy excellent in workability, particularly in extrudability, which has a medium strength of from 25 to 40 kg/mm$^2$, especially from 30 to 40 kg/mm$^2$ required when using as a material for structural sections.

SUMMARY OF THE INVENTION

An object of the present invention is therefore to provide a corrosion resistant aluminum alloy excellent in workability, particularly in extrudability, which has a strength after a heat treatment of from 25 to 40 kg/mm$^2$, especially from 30 to 40 kg/mm$^2$ required when using as a material for structural sections.

In accordance with one of the features of the present invention, there is provided a corrosion resistant structural aluminum alloy excelllent in extrudability, which consists essentially of, in weight percentage:

Magnesium from 0.45 to 0.98%,
Silicon from 0.3 to 0.8%,
Zinc from 0.5 to 0.25%, and, the balance aluminum and incidental impurities; said alloy including a corrosion resistant structural aluminum alloy excellent in extrudability further additionally containing, as required, at least one element selected from the group consisting of, in weight percentage:

Copper from 0.04 to 0.30%,
Zirconium from 0.04 to 0.25%,
Chromium from 0.04 to 0.30%, and,
Manganese from 0.04 to 0.25%;

said alloys also including a corrosion resistant structural aluminum alloy excellent in extrudability further additionally containing, as required, at least one element selected from the group consisting of in weight percentage:

Titanium from 0.01 to 0.20%, and,
Boron from 0.01 to 0.06%.

DETAILED DESCRIPTION OF PREFERRED EMBODIMENTS

With a view to obtaining an aluminum alloy satisfying all of the following conditions (a) to (d), we have carried out extensive studies:

(a) to have an excellent extrudability well comparable to that of the conventional JIS 6063 aluminum alloy;
(b) to have a strength well comparable to that of the conventional JIS 6061 aluminum alloy, i.e., a strength, after a heat treatment of from 25 to 40 kg/mm$^2$, particularly from 30 to 40 kg/mm$^2$, which is required when using as a material for structural sections;
(c) to have a corrosion resistance satisfactory even when using as a material for building structural sections; and
(d) not to require high manufacturing costs as compared with the conventional aluminum alloys.

As a result, we have found that the following phenomena appear by using as the basis the chemical composition of the conventional JIS 6063 aluminum alloy excellent in workability, particularly in extrudability, from among the Al-Mg-Si alloys, strictly limiting the magnesium (Mg) and silicon (Si) contents of said JIS 6063 alloy within specific ranges, and further adding zinc (Zn) in particular from among various constituent elements of an alloy:

(1) Zn dissolves into the matrix of the alloy to form a solid-solution;
(2) The Zn content, when exceeding a certain value, causes hardening of the matrix of the alloy with almost no effect on the other properties of the alloy, and raises the apparent degree of supersaturation of Mg and Si contained in the alloy, thus causing precipitation of fine $Mg_2Si$ in a larger quantity and improving the mechanical properties of the alloy;
(3) However, when the Zn content further increases to exceed a certain value, it impairs the ductility and the corrosion resistance of the alloy.

The present invention was achieved on the basis of the aforementioned findings (1) to (3), and the corrosion resistant structural aluminum alloy excellent in extrudability of the present invention is characterized by consisting essentially of, in weight percentage:

Magnesium from 0.45 to 0.98%,
Silicon from 0.3 to 0.8%,
Zinc from 0.5 to 2.5%, and, the balance aluminum and incidental impurities; said alloy including a corrosion resistant structural aluminum alloy excellent in extrudability further additionally containing, as required, at least one element selected from the group consisting of, in weight percentage:

Copper from 0.04 to 0.30%,
Zirconium from 0.04 to 0.25%,
Chromium from 0.04 to 0.30%, and,
Manganese from 0.04 to 0.25%;

said alloys also including a corrosion resistant sturctural aluminum alloy excellent in extrudability further additionally containing, as required, at least one element selected from the group consisting of, in weight percentage:

Titanium from 0.01 to 0.20%, and,
Boron from 0.01 to 0.06%.

Now, the reasons for limiting the ranges of the chemical composition of the aluminum alloy of the present invention as described above are given below:

(A) Magnesium, silicon and zinc:

Magnesium (Mg), silicon (Si) and zinc (Zn) are the indispensable constituent elements of the aluminum alloy of the present invention, and these three constituent elements have the effect of improving the strength of an aluminum alloy.

More specifically, the G.P. zones (the abbreviation of the "Guinier-Preston zones") and the intermediate precipitates both mainly comprising $Mg_2Si$ precipitated in the matrix of the alloy contribute to the mechanical properties of the alloy, by limiting the Mg content within the range of from 0.45 to 0.98 wt.%, the Si content, from 0.3 to 0.8 wt.% and the Zn content, from 0.5 to 2.5 wt.%, whereas the Zn content mostly dissolves into the matrix of the alloy to harden the solid-solution, and at the same time, increases the apparent supersaturation of $Mg_2Si$ in the alloy, causing fine $Mg_2Si$ to be precipitated in a larger quantity, and this is considered to improve the mechanical properties of the alloy.

However, with an Mg content of under 0.45 wt.% and an Si content of under 0.3 wt.%, the amount of precipitated $Mg_2Si$ is too small to give a desired medium strength after a heat treatment, i.e., a strength of from 25 to 40 kg/mm$^2$, particularly from 30 to 40 kg/mm$^2$. Therefore, the Mg content should be at least 0.45 wt.%, and the Si content, at least 0.3 wt.%. On the other hand, with an Mg content of over 0.98 wt.% and an Si content of over 0.8 wt.%, not only no particular improvement can be obtained in the strength of the alloy, but also, this tends to reduce the extrudability and the resistance to stress-corrosion cracking of the alloy. Therefore, the Mg content should be up to 0.98 wt.%, and the Si content, up to 0.8 wt.%.

Furthermore, a zinc content of under 0.5 wt.% does not permit achievement of the desired hardening effect of the alloy. The Zn content should therefore be at least 0.5 wt.%. On the other hand, a zinc content of over 2.5 wt.% does not give a particular improvement in the hardness of the alloy, and also tends to reduce the corrosion resistance, the resistance to stress-corrosion cracking and the ductility of the alloy. Therefore, the zinc content should be up to 2.5 wt.%.

As mentioned previously, the most important feature of the aluminum alloy of the present invention lies in that, with the chemical composition of the conventional JIS 6063 aluminum alloy as the basis, the Mg content and the Si content of said JIS 6063 alloy are strictly limited within specific ranges, and from among various alloying elements, Zn is added in an amount strictly limited within a specific range. The effect of adding Zn in the present invention is therefore demonstrated below with reference to some tests.

Test 1

Test aluminum alloys Nos. 1 to 4 in the form of sheets were prepared with chemical compositions achieved by adding Zn in amounts as shown in Table 1 to the chemical composition corresponding to the JIS 6063 alloy comprising 0.75 wt.% Mg, 0.50 wt.% Si and the balance aluminum. Then, said test alloys Nos. 1 to 4 were subjected to a solution treatment by holding them at 550° C. for one hour, and subsequently to an ageing treatment by holding them at 160° C. for 24 hours. Then, the mechanical properties of said test alloys Nos. 1 to 4 were measured. The results of said measurement are also indicated in Table 1.

TABLE 1

| Test alloy No. | Zn content (wt. %) | Mechanical property: Tensile strength (kg/mm$^2$) | Yield strength (kg/mm$^2$) | Elongation (%) |
|---|---|---|---|---|
| 1 | 0 | 28.8 | 25.6 | 10.0 |
| 2 | 1.04 | 30.8 | 28.0 | 10.3 |
| 3 | 2.09 | 33.0 | 30.2 | 11.6 |
| 4 | 3.07 | 33.4 | 30.0 | 9.5 |

In Table 1, the test alloy No. 1 corresponding to the JIS 6063 alloy not containing Zn and the test alloy No. 4 containing 3.07 wt.% Zn are aluminum alloys outside the scope of the present invention, whereas the test alloys Nos. 2 and 3 are aluminum alloys within the scope of the present invention.

As is evident from the results of the measurement given in Table 1, the tensile strength, the yield strength and the elongation improve substantially in proportion to the increase in the Zn content until the Zn content reaches about 2 wt.%. As in the case of the test alloy No. 4, however, an increase in the Zn content to about 3 wt.% brings about almost no improvement in the tensile strength and the yield strength as compared with the test alloy No. 3 having the Zn content of about 2 wt.%, with furthermore an elongation even inferior to that of the test alloy No. 1 not containing Zn. The above-mentioned results of the measurement suggest that, from the point of view of improving the strength of an aluminum alloy, the Zn content should preferably be within the range of from 0.5 to 2.5 wt.%.

Test 2

Test aluminum alloys Nos. 5 to 8 in the form of sheets were prepared with chemical compositions achieved by adding Zn in amounts as shown in Table 2 to the chemical composition corresponding to the JIS 6063 alloy comprising 0.65 wt.% Mg, 0.54 wt.% Si, 0.14 wt.% Fe and the balance aluminum. Then said test alloys Nos. 5 to 8 were subjected to a hot-torsion test under conditions of a deformation temperature of 450° C. and a strain rate of 1 sec.$^{-1}$ for the purpose of investigating the effect of the Zn content on the hot-workability of an aluminum alloy.

In said hot-torsion test, the maximum shear stress as an indicator of the deformation resistance and the fracture strain as an indicator of the ductility were measured. The results of said measurement are also indicated in Table 2.

A hot-torsion test is often carried out for estimating hot-workability, especially extrudability. The ductility determined in this test is known to correspond to the maximum extrusion rate, i.e., the critical extrusion rate at which an extrusion can be effected without causing any working crack.

TABLE 2

| Test alloy No. | Zn content (wt. %) | Hot-workability: Maximum shear stress (kg/mm$^2$) | Fracture strain |
|---|---|---|---|
| 5 | 0 | 2.24 | 256 |
| 6 | 1.06 | 2.13 | 300 |
| 7 | 1.99 | 2.05 | 310 |
| 8 | 2.93 | 2.03 | 290 |

In Table 2, the test alloy No. 5 corresponding to the JIS 6063 alloy not containing Zn and the test alloy No. 8 containing 2.93 wt.% Zn are aluminum alloys outside the scope of the present invention, whereas the test alloys Nos. 6 and 7 are aluminum alloys within the scope of the present invention.

As is clear from the results of the measurement shown in Table 2, the deformation resistance as represented by the maximum shear stress decreases, and the ductility as represented by the fracture strain increases substantially in proportion to the increase in the Zn content until the Zn content reaches about 2 wt.%. As in the case of the test alloy No. 8, however, an increase in the Zn content to about 3 wt.% not only causes almost no decrease in the deformation resistance as represented by the maximum shear stress, but also leads to a ductility as represented by a fracture strain inferior to that of the test alloy No. 7. It is known from the above-mentioned results that, from the standpoint of improving the extrudability of an aluminum alloy, the Zn content should preferably be within the range from 0.5 to 2.5 wt.%.

(B) Copper, zirconium, chromium and manganese:

In the present invention, at least one of copper (CU), zirconium (Zr), chromium (Cr) and manganese (Mn)

may be added, as required, with a view to improving the strength, or the ductility and the corrosion resistance of an aluminum alloy.

(1) Cu:

Cu has the effect of improving the strength of an aluminum alloy. However, a Cu content of under 0.04 wt.% cannot give a desired effect in the improvement of the strength of the alloy. The Cu content should therefore be at least 0.04 wt.%. On the other hand, a Cu content of over 0.30 wt.% causes a serious decrease in the extrudability and the corrosion resistance of the alloy. The Cu content should therefore be up to 0.30 wt.%.

(2) Zr:

Zr has the effect of improving the ductility and the corrosion resistance without impairing the extrudability of an aluminum alloy. However, a Zr content of under 0.04 wt.% cannot give a desired effect as mentioned above. The Zr content should therefore be at least 0.04 wt.%. On the other hand, a Zr content of over 0.25 wt.% not only causes formation of coarse intermetallic compounds when casting the alloy, thus leading to an inferior extrudability of the alloy, but also results in a lower strength of the alloy. The Zr content should therefore be up to 0.25 wt.%.

(3) Cr and Mn:

Cr and Mn have the effect of improving the ductility of an aluminum alloy by preventing brittle fracture of the alloy and also the effect of improving the corrosion resistance of the alloy. However, a Cr content and a Mn content each of under 0.04 wt.% cannot give a desired effect as mentioned above. The Cr content and the Mn content should therefore be at least 0.04 wt.% each. On the other hand, a Cr content of over 0.30 wt.% and an Mn content of over 0.25 wt.% not only cause formation of coarse intermetallic compounds when casting the alloy, thus leading to an inferior extrudability of the alloy, but also result in a lower strength of the alloy. The Cr content should therefore be up to 0.30 wt.% and the Mn content, up to 0.25 wt.%. It is possible to improve the ductility and the corrosion resistance of the alloy without almost any adverse effect on the extrudability and the strength of the alloy, by limiting each of the Cr content and the Mn content to up to 0.09 wt.%. It is therefore more desirable that the Cr content and the Mn content are up to 0.09 wt.% each.

(C) Titanium and boron:

Titanium (Ti) and boron (B) have the effect of improving the strength of an aluminum alloy by refining crystal grains of the alloy. In the present invention, therefore, at least one of Ti and B may be added, as required, for further improving the quality of the aluminum alloy.

However, a Ti content and a B content each of under 0.01 wt.% cannot give a desired effect as mentioned above. The Ti content and the B content should therefore be at least 0.01 wt.% each. On the other hand, with a Ti content of over 0.20 wt.% and a B content of over 0.06 wt.%, no particular improvement is observed in the aforementioned effect. Therefore, the Ti content should be up to 0.20 wt.% and the B content, up to 0.06 wt.%.

In addition to the chemical composition of the aluminum alloy of the present invention described above in detail, it is probable that iron (Fe) may be contained as one of incidental impurities. However, in the alloy of the present invention, Fe is a detrimental element impairing the extrudability of the alloy. An Fe content of over 0.19 wt.% tends to result in a lower extrudability of the alloy. Therefore, the Fe content should be the lowest possible, preferably up to 0.19 wt.%.

Now, the aluminum alloy of the present invention is described further in detail in comparison with reference alloys by means of examples.

EXAMPLE 1

Billets with a diameter of 17.8 mm and a length of 450 mm were prepared from aluminum alloys of the present invention Nos. 1 to 7 and reference aluminum alloys Nos. 1 and 2 outside the scope of the present invention respectively having chemical compositions as shown in Table 3.

TABLE 3

| | Alloy No. | Chemical composition (wt. %) Mg | Si | Zn | Cu | Zr | Cr | Mn | Fe | Al and incidental impurities |
|---|---|---|---|---|---|---|---|---|---|---|
| Alloy of the present invention | 1 | 0.65 | 0.54 | 1.0 | — | — | — | — | 0.17 | Balance |
| | 2 | 0.65 | 0.54 | 2.0 | — | — | — | — | 0.19 | " |
| | 3 | 0.65 | 0.54 | 2.0 | 0.2 | — | — | — | 0.16 | " |
| | 4 | 0.65 | 0.54 | 2.0 | — | 0.1 | — | — | 0.18 | " |
| | 5 | 0.65 | 0.54 | 2.0 | — | — | 0.18 | — | 0.19 | " |
| | 6 | 0.65 | 0.54 | 2.0 | — | — | — | 0.18 | 0.17 | " |
| | 7 | 0.65 | 0.54 | 2.0 | 0.16 | 0.11 | — | — | 0.18 | " |
| Reference alloy | 1 | 0.65 | 0.54 | — | — | — | — | — | 0.18 | " |
| | 2 | 1.2 | 0.8 | — | 0.24 | — | 0.2 | — | 0.24 | " |

In Table 3, the reference alloy No. 1 has a chemical composition corresponding to the typical chemical composition of the JIS 6063 aluminum alloy excellent in extrudability and corrosion resistance, and the reference alloy No. 2 has a chemical composition corresponding to the typical chemical composition of the JIS 6061 aluminum alloy excellent in strength after a heat treatment. The alloys of the present invention Nos. 1 and 2 have the same Mg content and the same Si content as those of the reference alloy No. 1, added with Zn, and the alloys of the present invention Nos. 3 to 7 are further added with Cu, Zr, Cr and/or Mn.

The aforementioned billets respectively made of the alloys of the present invention Nos. 1 to 7 and the reference alloys Nos. 1 and 2 shown in Table 3 were subjected to an extrusion test. In said extrusion test, each of said billets were extruded with the use of a 1,650-ton water-hydraulic extruder under conditions of a billet preheating temperature of 530° C. and a container preheating temperature of 460° C. to manufacture a rectangular pipe shaped extruded section having outside dimensions of 35 mm×70 mm and a wall thickness of 2 mm for measuring the maximum extrusion pressure during extruding. The extrusion rate was 15 meters per minute for the reference alloy No. 2 and 18 meters per minute for the other alloys.

Table 4 shown measured values of the maximum extrusion pressure in said extrusion test.

TABLE 4

| Alloy No. | | Maximum extrusion pressure ($kg/cm^2$) |
|---|---|---|
| Alloy of the present invention | 1 | 160 |
| | 2 | 158 |
| | 3 | 163 |
| | 4 | 160 |
| | 5 | 178 |
| | 6 | 164 |
| | 7 | 161 |
| Reference alloy | 1 | 163 |
| | 2 | 196 |

As is evident from the results of the measurement given in Table 4, the alloys of the present invention Nos. 1 to 4, 6 and 7, except for the alloy of the present invention No. 5 containing Cr, show in all cases a maximum extrusion pressure substantially equal to or lower than that of the reference alloy No. 1 corresponding to the JIS 6063 alloy excellent in extrudability. The maximum extrusion pressure of the alloy of the present invention No. 5 is slightly higher than that of the reference alloy No. 1. However, in spite of the extrusion rate of the alloy of the present invention No. 5 of 18 meters per minute higher than the extrusion rate of the reference alloy No. 2 corresponding to the JIS 6061 alloy of 15 meters per minute, the maximum extrusion pressure of the alloy of the present invention No. 5 is considerably lower than that of the reference alloy No. 2.

The aluminum alloy of the present invention has thus an extrudability which is well comparable to that of the JIS 6063 aluminum alloy excellent in extrudability and which is far superior to that of the JIS 6061 aluminum alloy.

EXAMPLE 2

The rectangular pipe shaped extruded sections of the alloys of the present invention Nos. 1 to 7 and the reference alloys Nos. 1 and 2 obtained in Example 1 were subjected to a solution treatment by holding them at 550° C. for one hour, then water-cooled or air-cooled, and subsequently subjected to an ageing treatment by holding them at 160° C. for 24 hours. The ageing treatment of the reference alloy No. 2 was however carried out by holding it at 180° C. for 4 hours.

Then, each of thus heat-treated extruded sections as mentioned above was subjected to a tensile test to measure the tensile strength, the yield strength and the elongation. The values of the measurement are given in Table. 5.

TABLE 5

| | Alloy No. | Water-cooled extruded section | | | Air-cooled extruded section | | |
|---|---|---|---|---|---|---|---|
| | | Tensile strength ($kg/mm^2$) | Yield strength ($kg/mm^2$) | Elongation (%) | Tensile strength ($kg/mm^2$) | Yield strength ($kg/mm^2$) | Elongation (%) |
| Alloy of the present invention | 1 | 30.1 | 28.4 | 10.3 | 28.3 | 27.0 | 8.2 |
| | 2 | 32.4 | 30.6 | 10.7 | 30.7 | 29.0 | 7.9 |
| | 3 | 34.0 | 31.9 | 11.2 | 32.5 | 30.5 | 8.1 |
| | 4 | 31.9 | 30.1 | 12.3 | 30.5 | 28.2 | 10.7 |
| | 5 | 31.1 | 29.2 | 10.7 | 28.7 | 27.5 | 9.4 |
| | 6 | 30.7 | 28.7 | 11.7 | 29.1 | 27.4 | 10.4 |
| | 7 | 32.7 | 30.7 | 11.8 | 29.7 | 27.6 | 11.0 |
| Reference alloy | 1 | 28.2 | 26.0 | 10.0 | 25.3 | 23.6 | 8.8 |
| | 2 | 31.2 | 28.3 | 12.1 | 28.4 | 23.7 | 9.0 |

As shown in Table 5, all the alloys of the present invention Nos. 1 to 7 show a strength substaially equal to or even higher than the strength of the reference alloy No. 2 corresponding to the JIS 6061 alloy excellent in strength after a heat treatment, and a strength far superior to that of the reference alloy No 1 corresponding to the JIS 6063 alloy.

Also as is clear from the results shown in Table 5, the degree of the decrease in strength caused by the difference in the quenching rate between air cooling and water cooling in the alloys of the present invention Nos. 1 to 7 is substantially equal to or smaller than that in the reference alloy No. 2. This suggests that the alloys of the present invention Nos. 1 to 7 have a lower sensibility to quenching as compared with the reference alloy No. 2. Furthermore, Table 5 indicates that the addition of such transition elements as Zr, Mn and Cr improves the ductility of the aluminum alloys.

As described above, the aluminum alloy of the present invention has a strength after a heat treatment which is well comparable to that of the JIS 6061 aluminum alloy excellent in strength after a heat treatment, and which is far superior to that of the JIS 6063 aluminum alloy.

EXAMPLE 3

A corrosion test was conducted for each of the water-cooled extruded sections of the alloy of the present invention Nos. 1 to 7 and the reference alloys Nos. 1 and 2 obtained in Example 2. Said corrosion test was carried out through a salt spray test, in accordance with JIS-Z2371, comprising measuring the weight loss by corrosion after the lapse of 200 hours of spraying an aqueous solution of 5% NaCl at a temperature of 35° C. Table 6 shows the measured values of the weight loss by corrosion in said salt spray test.

TABLE 6

| | Alloy No. | Weight loss by corrosion ($mg/dm^2$) |
|---|---|---|
| Alloy of the present invention | 1 | 12.3 |
| | 2 | 13.7 |
| | 3 | 21.0 |
| | 4 | 2.8 |
| | 5 | 3.5 |
| | 6 | 5.4 |
| | 7 | 2.0 |
| Reference alloy | 1 | 5.7 |
| | 2 | 23.1 |

As is clear from the results of the measurement given in Table 6, the alloys of the present invention Nos. 1 to 3 have a corrosion resistance slightly inferior to that of the reference alloy No. 1 corresponding to the JIS 6063 alloy excellent in corrosion resistance, whereas the alloys of the present invention Nos. 4 to 7 containing such transition elements as Zr, Mn and Cr are superior in corrosion resistance to the reference alloy No. 1. All the alloys of the present invention Nos. 1 to 7 have a corrosion resistance far superior to that of the reference alloy No. 2 corresponding to the JIS 6061 alloy.

Furthermore, the alloys of the present invention Nos. 1 to 3 which were inferior in corrosion resistance to the reference alloy No. 1 in the salt spray test described above, and the reference alloy No. 1 were subjected to an anodizing treatment in a sulphuric acid solution and a sealing treatment in a boiling water, and then to a CAS test (the abbreviation of the "copper-modified acetic salt test"), in compliance with JIS-H8601, comprising spraying for 16 hours an aqueous solution of 5% NaCl and 0.26 g/l $CuCl_2$ at a temperature of 50° C. Table 7 shows the results of said CAS test.

TABLE 7

| | Alloy No. | Anodic oxidation property | Weight loss by corrosion ($mg/dm^2$) |
|---|---|---|---|
| Alloy of the present invention | 1 | Normal | 18.5 |
| | 2 | " | 15.8 |
| | 3 | " | 18.9 |
| Reference alloy | 1 | " | 16.9 |

As shown in Table 7, the alloys of the present invention Nos. 1 to 3 are by no means inferior to the reference alloy No. 1 corresponding to the JIS 6063 alloy in terms of the anodic oxidation property. Moreover, the oxide films formed on the surfaces of the alloys of the present invention Nos. 1 to 3 have a corrosion resistance of almost the same order as that of the reference alloy No. 1. Therefore, in view of the fact that building structural sections are usually put into service after subjecting them to an anodic oxidation treatment, the corrosion resistance of the alloys of the present invention Nos. 1 to 3 is on a satisfactory level to permit application as materials for building structural sections.

Furthermore, a test was carried out on the resistance to stress-corrosion cracking of the alloys of the present invention Nos. 1 to 7, and there was produced no stress-corrosion cracking, which might be caused by the addition of Zn.

The aluminum alloy of the present invention has thus a corrosion resistance which is well comparable to that of the JIS 6063 aluminum alloy excellent in corrosion resistance after a heat treatment, and which is superior to that of the JIS 6061 aluminum alloy.

According to the present invention, as described above in detail, it is possible to obtain a corrosion resistant structural aluminum alloy which has excellent extrudability and corrosion resistance well comparable to those of the JIS 6063 aluminum alloy excellent in extrudability and corrosion resistance, and which has a strength after a heat treatment of 25 to 40 $kg/mm^2$, particularly 30 to 40 $kg/mm^2$ substantially equal or superior to that of the JIS 6061 aluminum alloy widely applied at present as a material for structural sections, thus providing industrially useful effects.

What is claimed is:

1. An extruded corrosion-resistant aluminum alloy structural element having a strength of from 25 to 40 $kg/mm^2$ prepared by extrusion and heating treatment of an aluminum alloy which consists essentially of, in weight percentage magnesium from 0.45 to 0.98%,
silicon from 0.3 to 0.8%,
zinc from 0.5 to 2.5%,
and
the balance aluminum and incidental impurities.

2. The aluminum alloy structural element of claim 1, wherein said aluminum alloy also contains at least one element selected from the group consisting of copper from 0.04 to 0.30%,
zirconium from 0.04 to 0.25%,
chromium from 0.04 to 0.30%,
and
manganese from 0.04 to 0.25%.

3. The aluminum alloy structural element of claim 2, wherein said chromium content and said manganese content are respectively within the range of from 0.04 to 0.09%.

4. The aluminum alloy structural element of claim 1 or 2 or 3, wherein said aluminum alloy also contains at least one element selected from the group consisting of titanium from 0.01 to 0.20%,
and
boron from 0.01 to 0.06%.

* * * * *